United States Patent [19]

Levine

[11] 4,435,123

[45] Mar. 6, 1984

[54] COOLING SYSTEM FOR TURBINES

[75] Inventor: Richard Levine, Bloomfield, Conn.

[73] Assignee: United Technologies Corporation, Hartford, Conn.

[21] Appl. No.: 369,700

[22] Filed: Apr. 19, 1982

[51] Int. Cl.[3] ..... F01D 5/18

[52] U.S. Cl. ..... 416/95; 415/115

[58] Field of Search ..... 415/115, 116, 178; 416/95, 97 R

[56] References Cited

U.S. PATENT DOCUMENTS

| | | | |
|---|---|---|---|
| 3,529,906 | 9/1970 | McLaurin et al. | 415/180 X |
| 3,565,545 | 2/1971 | Bobo et al. | 415/115 X |
| 3,768,921 | 10/1973 | Brown et al. | 416/95 X |
| 3,936,216 | 2/1976 | Dixon | 416/95 X |
| 3,989,410 | 11/1976 | Ferrari | 416/95 X |
| 4,348,157 | 9/1982 | Campbell et al. | 416/95 |

FOREIGN PATENT DOCUMENTS

| | | | |
|---|---|---|---|
| 2054046 | 2/1981 | United Kingdom | 415/115 |

*Primary Examiner*—Stephen Marcus
*Assistant Examiner*—Joseph M. Pitko
*Attorney, Agent, or Firm*—Charles A. Warren

[57] ABSTRACT

A unitary structure for use in supplying cooling air to the upstream face of the first stage turbine disk and to the turbine blades on the disk, the structure being a single cast structure having attachment means thereon by which it may be secured to the inner ends of the turbine vanes and also to a part of the combustion chamber such as the inner combustion chamber wall. The structure also provides for attachment of a seal ring to the unitary structure and also includes the turning vanes or nozzles by which the cooling air is directed against the disk, these vanes being cast integrally with the remainder of the structure.

6 Claims, 3 Drawing Figures

58'
58
58'
56
81
79
80
78
79
80
72
77
70
70

COOLING SYSTEM FOR TURBINES

DESCRIPTION

1. Technical Field

The invention relates to a unitary cast cooling device for use in supplying air for cooling the face of a gas turbine disk and the blades on the disk and utilizing a minimum amount of cooling air in so doing.

2. Background art

The turbine disk and blades have been cooled by such devices as that shown in U.S. Pat. to Brown et al No. 3,768,921 in which tubes with nozzles thereon are supported in the wall of the cooling air chamber and are positioned to blow air tangentially against the turbine disk. This structure has a plurality of parts that must be assembled to create the finished structure. Further the discharge of air from each nozzle necessarily impinges upon the adjacent tubes and the result is turbulence that detrimentally affects the cooling function and thus requires a greater amount of cooling air. It is desirable that the cooling air flow smoothly from the nozzles against the turbine disk. It is also desirable that the cooling structure by which cooling air is supplied to the nozzle be as simple and made of as few parts as possible.

DISCLOSURE OF INVENTION

A feature of the invention is a unitary structure that includes the cooling air chamber and the nozzles and is so arranged that it may easily be secured in position in the engine.

Another feature is a unitary structure that also serves as a structural element in the engine functioning for example to support a sealing element and the first stage vanes, also functioning as an interconnection between a part of the combustion chamber which is a structural part of the engine and the inner ends of the turbine vanes.

According to the invention the cooling structure has a mounting by which it is supported from the engine structure, an annular flange that connects to the inner ends of the first stage vanes of the engine, an annular chamber through which the cooling air is directed to the nozzles which are also an integral part of the structure. This structure may also have a mounting for a seal ring and is so arranged as to permit access to the bolts by which the seal ring is attached. The nozzles are defined by spaced turning vanes cast into the structure and these nozzles direct cooling air against the turbine disk in a tangential direction in a substantially complete ring for most effective and uniform delivery of the air for cooling.

The foregoing and other objects, features and advantages of the present invention will become more apparent in the light of the following detailed description of the preferred embodiments thereof as shown in the accompanying drawing.

BEST MODE FOR CARRYING OUT THE INVENTION

Figure 1:
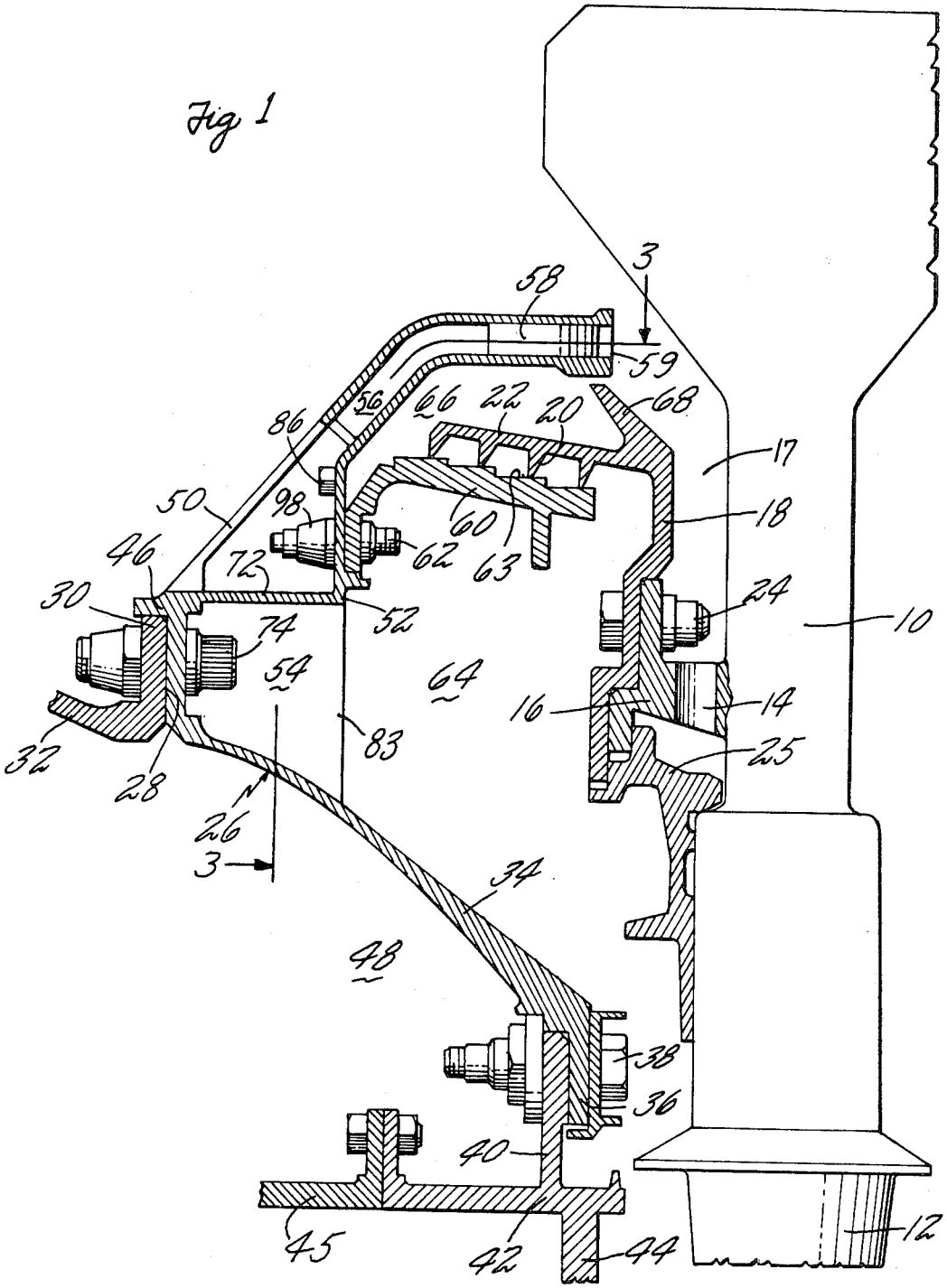
FIG. 1 is a sectional view through the cooling structure and a portion of the adjacent engine structure the section being substantially along the line 1—1 of FIG. 2

With reference first to FIG. 1 the first stage disk 10 of the turbine has a row of blades 12 on its periphery to which cooling air is delivered through holes 14 in a flange 16 on the side of the disk. Cooling air reaches the holes 14 from a chamber 17 radially inward of the flange 16 and later described in greater detail. From these holes cooling air flows radially outward and reaches the roots of the blades by any well known structure and passes through cooling passages in the blades not shown.

The flange 16 has bolted thereon an annular disk 18 that has a series of seal elements 20 on a conical flange 22 on the disk. Bolts 24 hold the disk 18 on the flange 16 and the outer periphery of the disk 18 holds a ring 25 against the disk 10 and against the blade roots to guide the cooling air into the blades and may serve to hold the blades in position within the disk. This is not a part of the present invention and will not be described in any greater detail.

The cooling structure 26 of the invention is in the form of an annulus having on its outer upstream face a mounting surface 28 by which to secure to it an annular flange 30 on a part 32 of the combustion chamber. The part 32 is generally of substantially cylindrical construction and may be the inner wall of the combustion chamber and is thus a structural part of the engine. Extending outwardly from the surface 28 is a frusto-conical flange or wall element 34 the outer periphery 36 of which is secured as by bolts 38 to mounting feet 40 extending inwardly from the inner ends 42 of the turbine inlet vanes 44. This element 34 defines with the feet 40 and a wall 45 extending forwardly from the ends 42 of the vanes, a chamber 48 to which cooling is supplied by any means not shown as from a space between the chamber wall 32 and the burner structure surrounding the wall 32.

At the mounting surface 28 there is an axially extending flange 46 that serves to locate the flange 30 radially of the cooling structure. Also at this point on the cooling structure the latter becomes a double wall structure having an upstream wall 50 and a downstream wall 52 spaced apart to form a circumferentially extending chamber 54 therebetween. These walls continue radially inwardly to define an annular passage 56 from the space 54 to the discharge nozzles 58 which are integral with and are positioned between the opposed walls at the inward end thereof. These walls which at the space 54 extend radially change direction to the inner ends thereof so that at the nozzle end they extend substantially axially to define an axial discharge opening 59 for the cooling air. At a point radially inward from the chamber 54 the downstream wall has a seal ring 60 secured thereto as by a row of bolts 62. This ring has a series of steps 63 on the frusto-conical portion thereof to cooperate with the series of seal lands 20. The cooperating seal elements form with the downstream wall 52, disk 18 and wall element 34 a chamber 64 radially outward from the seal. Another chamber 66 is formed radially inward of the seal elements and the other walls of this chamber are the inner portion of the downstream wall 52 and an inwardly extending flange 68 on the seal disk 18 that extends toward and into close proximity to the ends of the wall 52.

Figure 2:
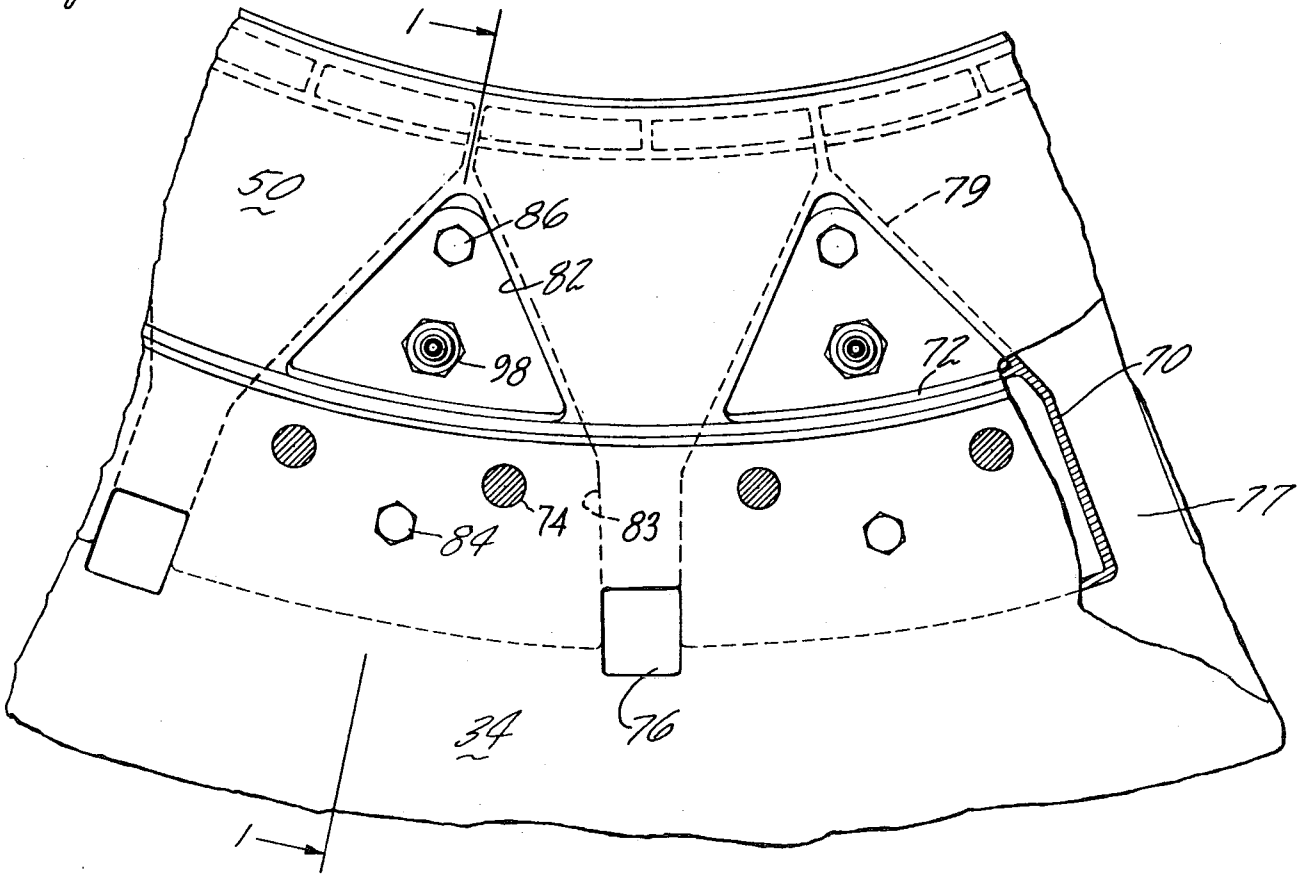
FIG. 2 is an end view of the cooling structure with parts broken away.
Figure 3:
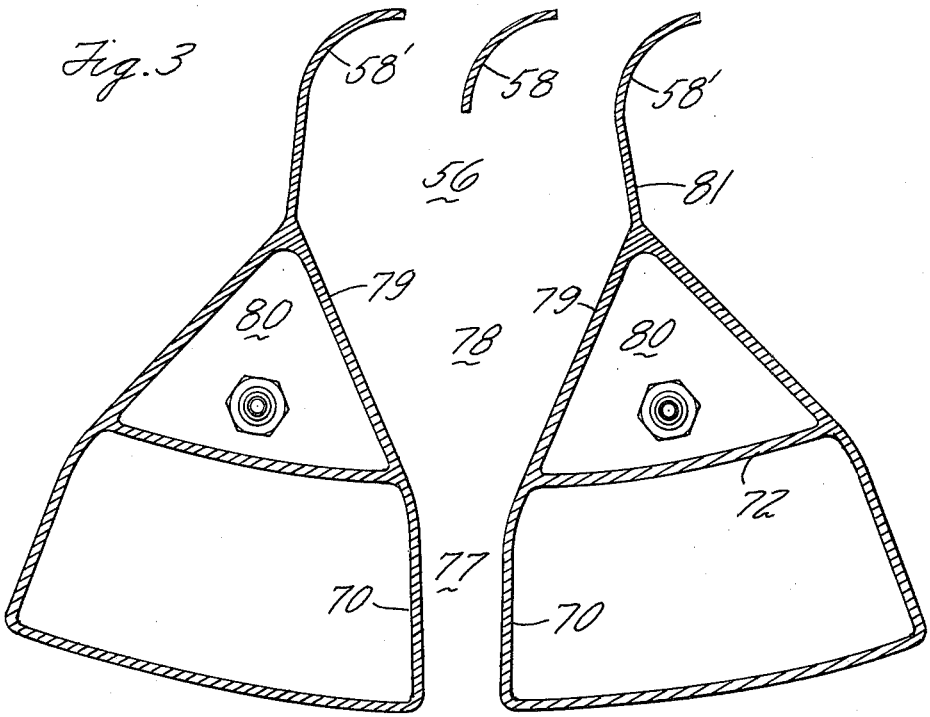
FIG. 3 is a sectional view of the cooling structure substantially along the line 3—3 of FIG. 1.

The annular chamber 54 has axially positioned partitions 70, FIGS. 2 and 3, extending between the upstream and the downstream walls and projecting radially inward from the element 34 to a circumferential wall 72 forming an interrupted ring or wall between the upstream and downstream walls. This circumferential or cylindrical wall 72 is just radially inward of the row of bolts 74 that holds the cooling structure to the wall 32. The partitions 70 are arranged in pairs as shown in FIGS. 2 and 3 and the circumferential wall 72 is interrupted where these paired partitions are located so that cooling air may enter the inner openings 76 in the element 34 and flow in the passage 77 defined between the paired partitions and pass the circumferential wall 72 into the passage 78. As above stated the circumferential wall 72 is interrupted at these partitions as shown.

Radially inwardly of the circumferential wall 72 the extensions 79 of the paired partitions 72 diverge from each other so that the extension of opposite partitions of adjacent pairs converge to define triangular spaces 80 radially inward of the circumferential wall 72. These opposed extensions merge and become a single partition 81 that extends forward and almost to the downstream ends of the upstream and downstream walls. These partitions extend to and are integral with alternate nozzle vanes 58'. The intervening vanes 58 serve only as turning vanes near the discharge end of the passage 56. The partitions 81, however, serve to assure a fairly constant air pressure for the cooling air for the entire circumference of the cooling air passage 56.

The upstream wall 50 has triangular openings 82 for the chambers or spaces 80. The bolts 62 for the seal ring 60 are located in the downstream wall where these spaces 80 are located so that the nuts 98 of the bolts are accessible through the triangular openings thereby permitting removal of the seal ring 60 from its attachment to the cooling structure. The downstream wall 52 has openings 83 therein located between the pairs of partitions to provide access to the heads of bolts 74 thereby permitting attachment of the cooling structure to the element 32.

The cooling structure as above described is a single piece casting and may be made by the investment casting process. The result is a precision onepiece construction that is readily installed in the engine and serves as a support for the seal and an interconnection between a combustion chamber sleeve or ring (a structural part of the engine) and the inner ends of the turbine vane. In addition the installation of the structure creates the several chambers for cooling air and for sealing air and provides suitable passages in the structure to permit the desired flow of air through this portion of the engine. Access to the supporting and connecting bolts is possible by the structure described thus facilitating installation or removal of the cooling structure from the engine.

The construction provides further for installation of pressure taps or pressure connections for sensing or adjusting the pressure in several of the chambers. Thus if the pressure in chamber 64 is in question a pressure tap 84 in the upstream wall 50 near the bolts 74 permits direct connection with the chamber 64 by reason of the openings 83 which permit the pressure in chamber 64 to enter the space between the upstream and downstream walls in the area where the bolts 74 are located. Further a pressure tap 86 gives access from a point forwardly of the upstream wall to chamber 66 for ascertaining this chamber's pressure or for increasing or decreasing the pressure as by adding or removing air therefrom. Obviously the pressure tap 86 is located at a point in alignment with the openings 82 which provide access to the spaces 79.

Although the invention has been shown and described with respect to a preferred embodiment thereof, it should be understood by those skilled in the art that other various changes and omissions in the form and detail thereof may be made therein without departing from the spirit and the scope of the invention.

I claim:

1. A cooling structure for supplying cooling air to a chamber at a face of a turbine disk the structure being a single unitary case article including:

spaced annular walls defining an air flow chamber and terminating at one end in an axially positioned discharge nozzle having vanes therein extending between the walls and integral therewith;

an annular connecting element integral with and connecting said walls at the ends remote from the nozzle, said element extending from said walls and having mounting means on the end remote from the wall;

radially extending partitions integral with extending between and connecting the spaced walls and defining circumferentially spaced flow passages for air from said connecting element to the nozzle, the element having air inlet holes therein;

an interrupted substantially cylindrical partition integral with and between said walls at a point spaced from said connecting element, said cylindrical partition being interrupted to form openings therein at points in alignment with the holes in the connecting element for a flow of air from said holes to said openings between selected partitions and one of said annular walls having first access openings therein out of alignment with the holes in the connecting walls and the openings in the cylindrical partition, the other of said annular walls having attachment means therein for access through the openings in said one of said annular walls.

2. A cooling structure as in claim 1 in which the openings in said one of said walls are located between partitions other than the selected positions between which the cooling flow is directed.

3. A cooling structure as in claim 1 in which certain adjacent radially extending partitions on the one side of the cylindrical element converge toward one another and merge to form a single partition extending to and integral with certain of the vanes.

4. A cooling structure as in claim 1 in which said other wall has second access openings therein substantially in radial alignment with the openings in said one of said walls, said second access openings being located on the opposite side of the cylindrical partitions from said first access openings.

5. A cooling structure for supplying cooling air to a chamber at a face of a turbine disk, the structure being a single unitary cast article including:

spaced annular walls extending in a generally radial direction from their outer ends and changing direction to an axial direction at their inner ends, said walls having integral vanes adjacent their inner ends to form nozzles for directing cooling air against the disk;

an annular connecting element integral with the spaced outer ends of the annular walls and extending outwardly therefrom, said element having an attachment flange at its outer end;

an annular cylindrical partition extending between the spaced walls and integral therewith and spaced radially inwardly from said connecting element;

substantially radial partitions between and integral with the spaced walls and between said connecting element and said cylindrical partition and integral therewith, said connecting element and cylindrical partition having openings therein in radial alignment and located between selected pairs of radial partitions for a flow of air therethrough and to the nozzles;

inward extensions of certain selected adjacent partitions of said radial partitions between which the cooling air flows diverging to merge with adjacent partitions to define triangular spaces therebetween; and one of said spaced annular walls having openings therein communicating with the said triangular spaces, the other wall having mounting means at these triangular spaces for access through said openings in said one of said walls.

6. A cooling structure as in claim 5 in which one of said walls has mounting means located between the radial partitions in the area where there is no air flow and the other wall has openings therein for access to said mounting means.

* * * * *